US007067967B1

(12) United States Patent
Roberts et al.

(10) Patent No.: US 7,067,967 B1
(45) Date of Patent: Jun. 27, 2006

(54) ARC LAMP HAVING WINDOW FLANGE WITH SLOTS

(75) Inventors: Roy D. Roberts, Hayward, CA (US); James P. Huynh, Fremont, CA (US)

(73) Assignee: Vaconics Lighting, Inc., Sunnyvale, CA (US)

( * ) Notice: Subject to any disclaimer, the term of this patent is extended or adjusted under 35 U.S.C. 154(b) by 0 days.

(21) Appl. No.: 10/890,968

(22) Filed: Jul. 13, 2004

(51) Int. Cl.
*H01J 5/16* (2006.01)

(52) U.S. Cl. ..... 313/113

(58) Field of Classification Search ..... 313/113, 313/318.11

See application file for complete search history.

(56) References Cited

U.S. PATENT DOCUMENTS 4,633,128 A * 12/1986 Roberts et al. ..... 313/113
4,658,179 A * 4/1987 Roberts ..... 313/113
5,672,931 A * 9/1997 Kiss et al. ..... 313/44
5,721,465 A 2/1998 Roberts
5,789,863 A 8/1998 Takahashi et al.
6,181,053 B1 * 1/2001 Roberts ..... 313/46
6,285,131 B1 9/2001 Kiss et al.
6,351,058 B1 * 2/2002 Roberts ..... 313/113
6,400,067 B1 * 6/2002 Manning et al. ..... 313/46
6,561,675 B1 * 5/2003 Kavanagh ..... 362/263
6,597,087 B1 7/2003 Roberts et al.
6,602,104 B1 8/2003 Roberts
2003/0098652 A1 5/2003 Beech et al.

* cited by examiner

*Primary Examiner*—Joseph Williams
*Assistant Examiner*—Dalei Dong
(74) *Attorney, Agent, or Firm*—Blakely, Sokoloff, Taylor & Zafman LLP

(57) ABSTRACT

An arc lamp having window flange with slots has been disclosed. The arc lamp may include a reflector body having a circular rim at one end to define an opening, the circular rim having an outer diameter and an inner diameter and a window flange including a surface having a first end and a second end, the first end defining a circle having a diameter larger than the inner diameter of the circular rim of the reflector body, and the surface being brazed to the circular rim along at least a portion of the first end, wherein the window flange further includes a second surface extending from the first end of the first surface to define a plurality of slots. The arc lamp may further include a window mounted to the window flange near the second end of the window flange.

6 Claims, 3 Drawing Sheets

ARC LAMP HAVING WINDOW FLANGE WITH SLOTS

FIELD OF INVENTION

The present invention relates to arc lamps, and more particularly, to mounting an arc lamp.

BACKGROUND

In optical systems involving the generation and controlled radiation of long or continuous pulses of light, such as spectroscopy, or solar simulation, where high intensity, color correct illumination of sensitive working areas is required, such as in fiber optics illumination devices, it is advantageous to have a light source capable of producing the highest possible light flux density. Products utilized in such applications include short arc inert gas lamps, which may also be referred to as arc lamps. At least one arc lamp includes a sealed chamber containing a gas pressurized to several atmospheres, and an opposed anode and cathode defining an arc gap. A reflector body may be positioned surrounding the arc gap. A window provides for the transmission of the generated light.

One existing technique to mount the window to the arc lamp is to use a window flange and a support flange. FIG. 1A shows a cross-section view of an existing arc lamp having a window mounted using this technique. The portion of the arc lamp 100 illustrated in FIG. 1A includes a reflector body 110, a window frame ring 120, a window 130, a strut wing 140, a window flange 150, a support flange 160, a support ring 170, and a cathode 180. The reflector body 110 defines a cavity in which an anode and a cathode are positioned. The reflector body 110 has a rim 112. The rim 112, having an inner diameter and an outer diameter, defines a circular opening. Likewise, the support ring 170, having an inner diameter and an outer diameter, defines another opening.

To assemble the arc lamp 100, the support ring 170 is placed on top of the rim 112. The support ring 170 holds the strut wing 140, which is part of a strut assembly that holds the cathode 180 and suspends the cathode 180 through the opening defined by the rim 112 of the reflector body 110. The strut wing 140 may be brazed to the support ring 170.

As illustrated in FIG. 1A, the inner diameter of the support ring 170 is smaller than the inner diameter of the rim 112. Therefore, the support ring 170 projects into the light path of the light generated by the cathode and anode in the cavity defined by the reflector body 110, which goes through the opening defined by the rim 112. Consequently, the support ring 170 adversely affects the performance of the arc lamp 100.

The support flange 160 is brazed to the support ring 170 at the surface 162. Furthermore, the support flange 160 is coupled to the window frame ring 120 at the surface 164, typically by tungsten welding. The support flange 160 is brazed to the window flange 150 at the surface 166. The window flange 150 has a first end 152 and a second end 154. The first end 152 is coupled to a portion of the support ring 170 that extends beyond the rim 112 of the reflector body 110. The second end 154 of the window flange 150 holds the window 130.

FIG. 1B shows another cross-section view of the arc lamp described above. The corresponding components of the arc lamp 100 are marked with the same reference numerals as in FIG. 1A.

The above technique uses a lot of supporting parts, including the support flange 160, the support ring 170, and the window flange 150, to mount the window 130 and the strut wing 140. Furthermore, the above technique employs three or more brazing operations to braze together the window flange 150 and the support flange 160, the support flange 160 and the support ring 170, as well as the support ring 170 and the strut wing 140. As a result, the above technique is very complex and expensive.

SUMMARY

A method and an apparatus for mounting an arc lamp are described. In one embodiment, the arc lamp includes a reflector body having a circular rim at one end to define an opening, the circular rim having an outer diameter and an inner diameter and a window flange including a surface having a first end and a second end, the first end defining a circle having a diameter larger than the inner diameter of the circular rim of the reflector body, and the surface being brazed to the circular rim along at least a portion of the first end.

Other features of the present invention will be apparent from the accompanying drawings and from the detailed description that follows.

DESCRIPTION OF THE DRAWINGS

The present invention will be understood more fully from the detailed description that follows and from the accompanying drawings, which however, should not be taken to limit the appended claims to the specific embodiments shown, but are for explanation and understanding only.

DETAILED DESCRIPTION

In the following description, numerous specific details are set forth. However, it is understood that embodiments of the invention may be practiced without these specific details. In other instances, well-known components, structures, and techniques have not been shown in detail in order not to obscure the understanding of this description.

Figure 2A:
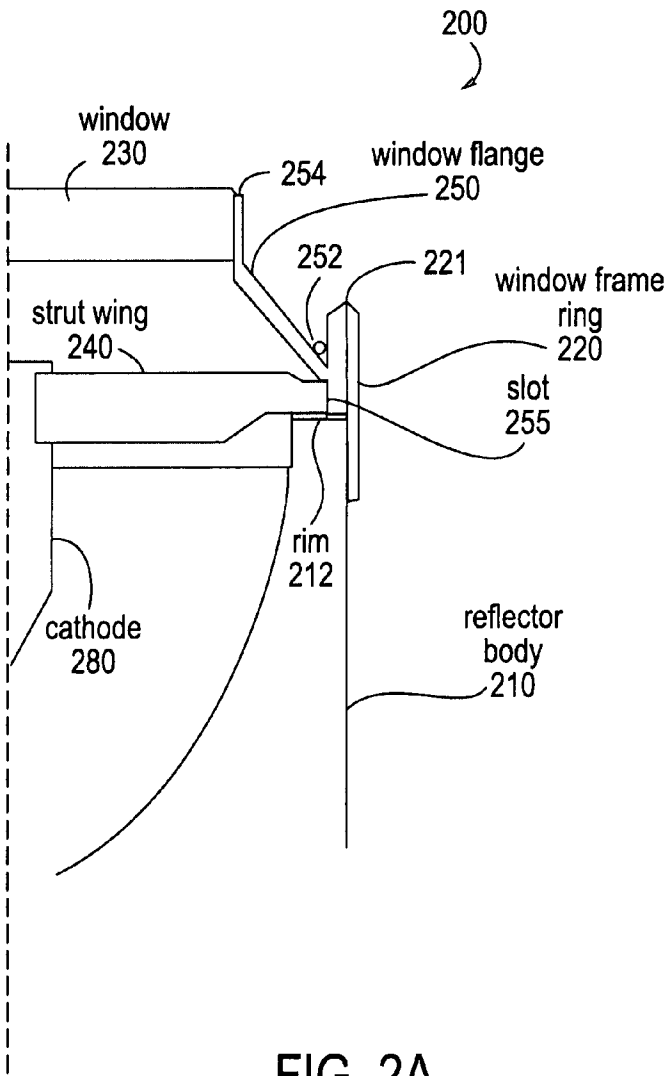
FIG. 2A shows a cross-section view of one embodiment of an arc lamp.

FIG. 2A shows a cross-section view of one embodiment of an arc lamp. For the purpose of illustration, only the right half of the cross-section is shown, which provides sufficient details to one of ordinary skill in the art to practice the embodiment of the present invention. The arc lamp 200 includes a reflector body 210, a window frame ring 220, a window 230, a strut wing 240, a window flange 250, and a cathode 280. Note that the components in FIG. 2A are shown for the purpose of illustration, not limitation. Other embodiments of the arc lamp may include more or less components than those illustrated in FIG. 2A.

The reflector body 210 has a rim 212. The rim 212 has an inner diameter and an outer diameter. The inner diameter of the rim 212 defines an opening. The reflector body 210 may be made of ceramic with a reflective coating put onto the inner surface. Part of the outer surface of the reflector body 210 that is near the rim 212 may be brazed to the window frame ring 220. The window frame ring 220 is also coupled to the window flange 250.

In one embodiment, the window flange 250 includes a surface 251 having a first end 252 and a second end 254. The window flange 250 holds the window 230 near the second end 254. The first end 252 of the window flange 250 may define a first circular opening. Likewise, the second end 254 may define a second circular opening. The diameter of the first circular opening is larger than the diameter of the second circular opening such that the surface 251 defines a slope extending from the second end 254 outwards towards the first end 252. By extending the surface 251 of the window flange 250 slightly outwards, the support flange 160 in the conventional arc lamp illustrated in FIGS. 1A and 1B may be eliminated.

Furthermore, the diameter of the first end 252 may be larger than the inner diameter of the rim 212 such that the window flange 250 can be brazed to the window frame 220 along at least a portion of the first end 252.

Figure 1A:
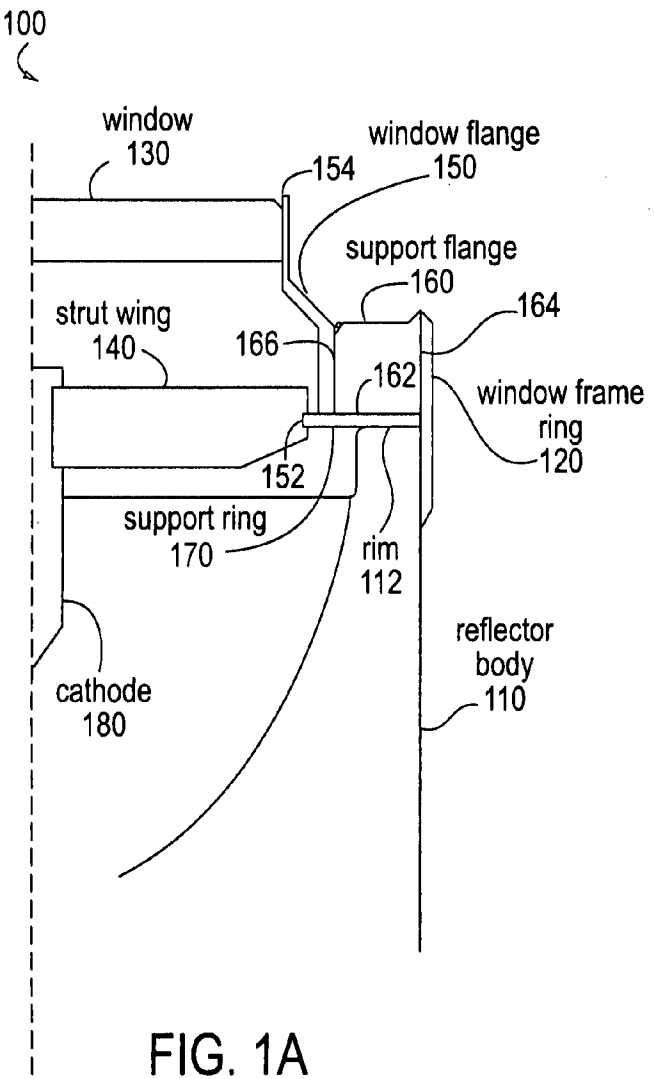
FIG. 1A (PRIOR ART)
FIG. 1A shows a first cross-section view of an existing arc lamp.
Figure 1B:
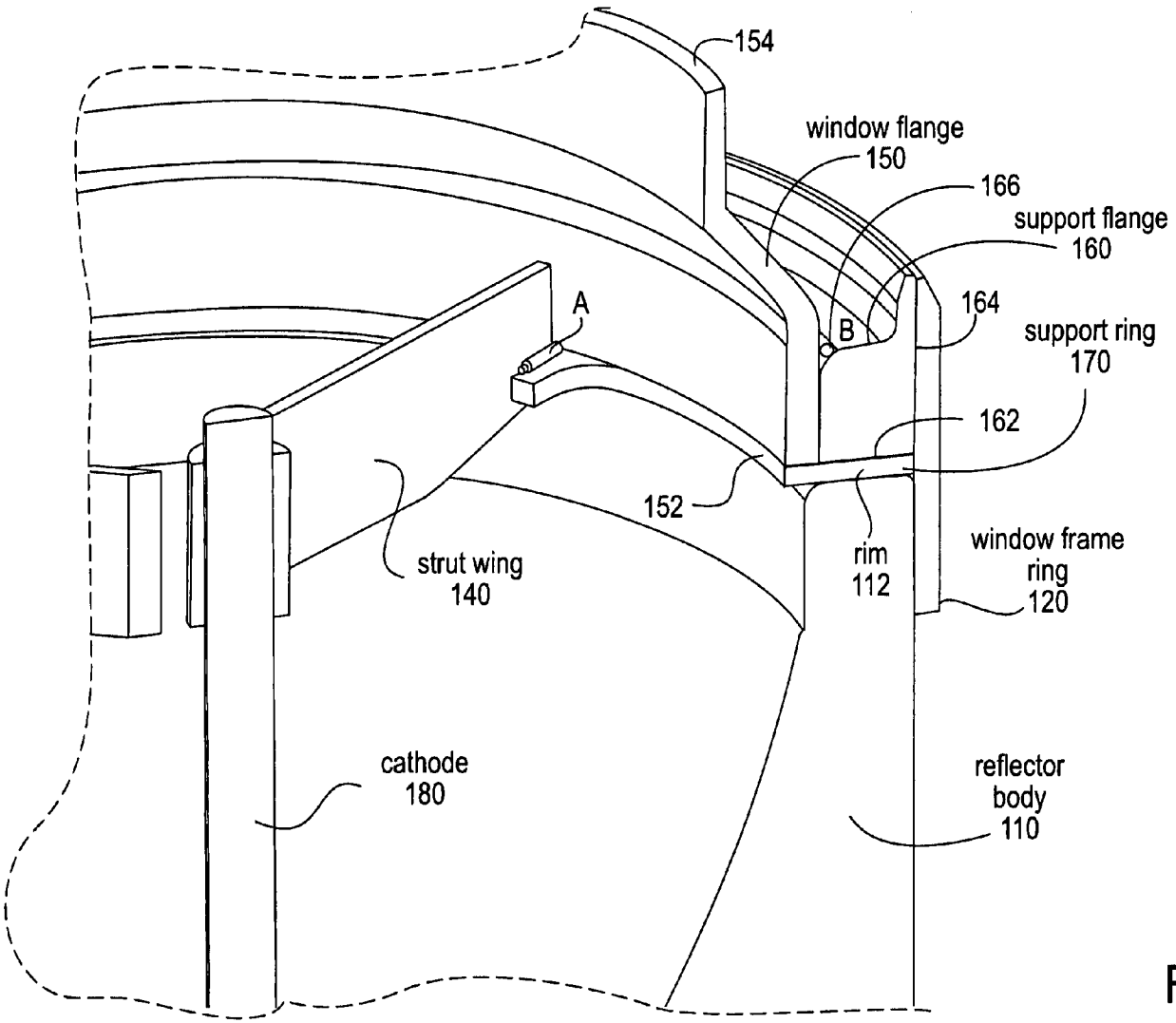
FIG. 1B (PRIOR ART)
FIG. 1B shows a second cross-section view of an existing arc lamp.

In one embodiment, the window flange 250 has a number of slots on the inner surface, such as the slot 255 shown in FIG. 2A. The strut wings (e.g., the strut wing 240) of the strut assembly that holds an electrode (e.g., the cathode 280) of the arc lamp 200 may be inserted into these slots 255. By inserting the strut wing 240 into the slot 255 on the window flange 250, the support ring 170 may be eliminated because the strut wing 240 can be supported by the window flange 250 instead. Furthermore, the support ring 170 as illustrated in FIGS. 1A and 1B projects into the light path of the arc lamp 100 as discussed above. By eliminating the support ring 170, obstruction in the light path in the arc lamp 200 may be reduced, and hence, resulting in better lighting performance.

In one embodiment, only a single brazing operation is performed to assemble the arc lamp 200. In one embodiment, the window flange 250 is brazed to the window frame ring 220 and the reflector body 210 at substantially the same time. In one embodiment, a single brazing material is deposited between the window flange 250, the rim of the reflector body 210, and all along the side of the window frame ring 220. The brazing material may include copper. Furthermore, the window frame ring 220 may be TIG-welded to the window flange 250 at 221 as indicated in FIG. 2A. Comparing with the existing approach described above, the technique disclosed greatly simplifies mounting the arc lamp 200 by eliminating at least two brazing operations.

Figure 2B:
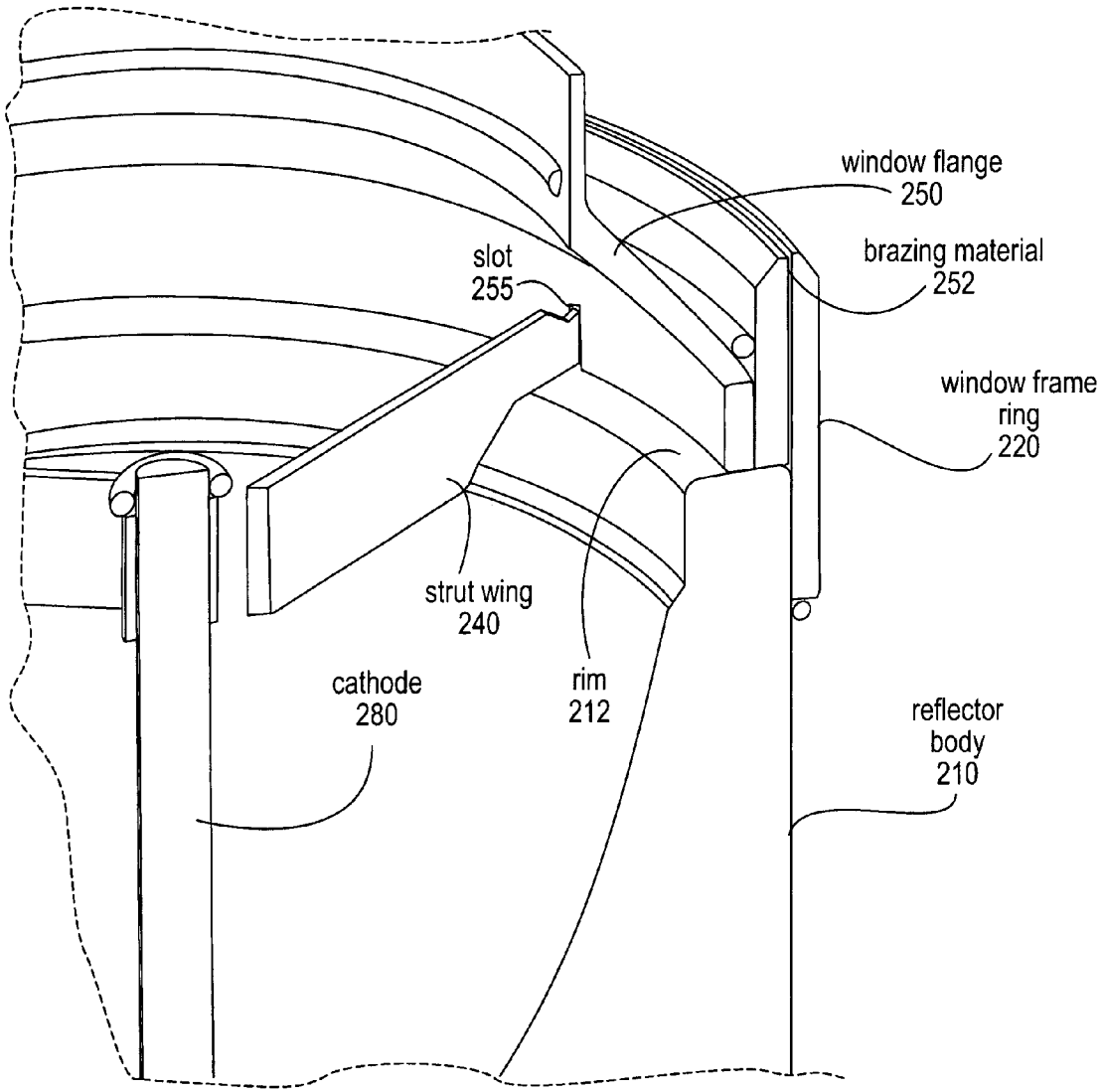
FIG. 2B shows a cross-section view of one embodiment of an arc lamp.

FIG. 2B shows another cross-section view of the embodiment of the arc lamp 200 described in FIG. 2A. The corresponding components of the arc lamp 200 are marked with the same reference numerals as in FIG. 2A.

In sum, the technique disclosed reduces the number of parts used to mount an arc lamp. Furthermore, the technique disclosed also simplifies the mounting of the arc lamp by reducing the number of brazing operations. Therefore, applying the technique disclosed to mount arc lamps greatly reduces the cost of manufacturing arc lamps.

The foregoing discussion merely describes some exemplary embodiments of the present invention. One skilled in the art will readily recognize from such discussion, the accompanying drawings and the claims that various modifications can be made without departing from the spirit and scope of the invention.

What is claimed is:

1. An arc lamp comprising:

a reflector body having a circular rim at one end to define an opening, the circular rim having an outer diameter and an inner diameter;

a window flange including a first surface having a first end and a second end, the first end defining a first circle having a first diameter larger than the inner diameter of the circular rim of the reflector body, and the window flange being brazed to the circular rim along at least a portion of the first end, wherein the window flange further comprises a second surface extending from the first end of the first surface to define a plurality of slots; and a window mounted to the window flange near the second end of the window flange.

2. The arc lamp of claim 1, wherein the second end of the window flange defines a second circle having a second diameter smaller than the first diameter such that the first surface defines a slope extending outwards from the second end to the first end.

3. The arc lamp of claim 2, further comprising:

a window frame ring coupled to the reflector body at or near the circular rim of the reflector body, wherein the first end of the window flange is coupled to at least part of the window frame ring.

4. The arc lamp of claim 1, further comprising a strut assembly having a plurality of strut wings, each of the plurality of strut wings being inserted into one of the plurality of slots of the window flange.

5. The arc lamp of claim 4, further comprising a first electrode held by the strut assembly and suspended through the opening defined by the circular rim of the reflector body.

6. The arc lamp of claim 5, further comprising a second electrode opposing the first electrode to define an arc gap between the first and second electrodes.

* * * * *